US010492534B2

(12) United States Patent
Suess et al.

(10) Patent No.: US 10,492,534 B2
(45) Date of Patent: Dec. 3, 2019

(54) ELECTRONIC SMOKING DEVICE AND ATOMIZER

(71) Applicant: FONTEM HOLDINGS 1 B.V., Amsterdam (NL)

(72) Inventors: Daniel Suess, Hamburg (DE); Vaclav Borkovec, Hamburg (DE)

(73) Assignee: FONTEM HOLDINGS 1 B.V., Amsterdam (NL)

( * ) Notice: Subject to any disclaimer, the term of this patent is extended or adjusted under 35 U.S.C. 154(b) by 0 days.

(21) Appl. No.: 15/519,432

(22) PCT Filed: Oct. 12, 2015

(86) PCT No.: PCT/EP2015/073580
§ 371 (c)(1),
(2) Date: Apr. 14, 2017

(87) PCT Pub. No.: WO2016/059000
PCT Pub. Date: Apr. 21, 2016

(65) Prior Publication Data

US 2017/0238613 A1 Aug. 24, 2017

(30) Foreign Application Priority Data

Oct. 16, 2014 (EP) ..... 14189197

(51) Int. Cl.
*A24F 13/00* (2006.01)
*A24F 17/00* (2006.01)
(Continued)

(52) U.S. Cl.
CPC ..... *A24F 47/008* (2013.01); *H05B 1/0244* (2013.01); *H05B 2203/021* (2013.01)

(58) Field of Classification Search
USPC ..... 131/329
See application file for complete search history.

(56) References Cited

U.S. PATENT DOCUMENTS 5,095,921 A * 3/1992 Losee ..... A24F 47/008 128/200.19
8,070,522 B2 * 12/2011 Shtargot ..... H05K 7/1492 439/638
(Continued)

FOREIGN PATENT DOCUMENTS

CN 102356929 A 2/2012
CN 202749479 U 2/2013
(Continued)

OTHER PUBLICATIONS

European Patent Office, "Extended European Search Report", for EP 14189197.8, dated Apr. 2, 2015, 5 pgs.
(Continued)

*Primary Examiner* — Abdullah A Riyami
*Assistant Examiner* — Thang H Nguyen
(74) *Attorney, Agent, or Firm* — Perkins Coie LLP; Kenneth H. Ohriner

(57) ABSTRACT

It is provided an electronic smoking device (1) with a housing (2) including an atomizer (6) and a liquid reservoir (4). The atomizer (6) comprises a heating wire (8) and at least a first contact finger (9) adapted to supply a first electrical potential to the heating wire (8). The first contact finger (9) is adapted to contact the heating wire (8) at a plurality of different contact portions (P1, P2, P3, P4) thereby altering the heating characteristics of the atomizer (6) which vaporizes liquid (5) supplied from the reservoir (4) to generate an aerosol (7).

15 Claims, 4 Drawing Sheets

(51) Int. Cl.

| | |
|---|---|
| ***A24F 25/00*** | (2006.01) |
| ***A24F 47/00*** | (2006.01) |
| ***H05B 1/02*** | (2006.01) |

(56) References Cited

U.S. PATENT DOCUMENTS

| | | | | |
|---|---|---|---|---|
| 2008/0092912 | A1 | 4/2008 | Robinson et al. | |
| 2014/0014124 | A1* | 1/2014 | Glasberg | A24F 47/008 131/328 |
| 2014/0209105 | A1 | 7/2014 | Sears et al. | |
| 2014/0290677 | A1* | 10/2014 | Liu | A24F 47/008 131/329 |
| 2015/0223522 | A1* | 8/2015 | Ampolini | A24F 47/008 131/328 |
| 2016/0106151 | A1* | 4/2016 | Swepston | A24F 47/002 |
| 2016/0374400 | A1* | 12/2016 | Monsees | A61M 15/06 131/329 |

FOREIGN PATENT DOCUMENTS

| | | | |
|---|---|---|---|
| CN | 203378562 | U | 8/2014 |
| EP | 0488488 | A1 | 6/1992 |

OTHER PUBLICATIONS

European Patent Office, "International Search Report and Written Opinion", for PCT/EP2015/073580, dated Feb. 1, 2016, 12 pp.
Taiwan Intellectual Property Office, Official Action in Taiwan Application No. 104133828; dated Jan. 4, 2019; 13 pages.
State Intellectual Property Office, Office Action for Chinese Application No. 201580065403.7; dated May 8, 2019; 8 pages.

* cited by examiner

ELECTRONIC SMOKING DEVICE AND ATOMIZER

CROSS-REFERENCE TO RELATED APPLICATIONS

This application is a national stage application under 35 U.S.C. 371 of International Application No. PCT/EP2015/073580, filed Oct. 12, 2015, titled ELECTRONIC SMOKING DEVICE AND ATOMIZER, the entirety of which is incorporated herein by reference.

BACKGROUND OF THE INVENTION

An electronic smoking device, e.g. designed as an electronic cigarette, generally has a housing containing an electric power source (usually a single use battery or a rechargeable battery), and an electrically operable atomizer. The atomizer vaporizes or atomizes liquid supplied from a reservoir (usually a capsule) and provides vaporized or atomized liquid as an aerosol. Control electronics controls activation of the atomizer. In many electronic cigarettes, a puff detector is provided within the electronic smoking device which detects a user puffing on the device (e.g., by sensing an under-pressure or an air flow pattern through the device). The puff detector indicates or signals the puff to the control electronics. Alternatively, a button may be used to switch on the electronic smoking device to generate a puff of favour. When a puff is detected, the control electronics supplies electrical power to the atomizer thereby creating vaporized liquid as an aerosol.

The heating wire may be required to provide different heating characteristics e.g. when different liquids are to be vaporized by a user. The heating wire may degrade due to repeated use.

SUMMARY OF THE INVENTION

In one aspect of the present invention, an atomizer is disclosed that is adapted to be used in an electronic smoking device. The atomizer comprises a heating wire and at least a one contact finger for supplying an electrical potential to the heating wire. The contact finger is adapted to contact the heating wire at a plurality of different contact portions thereby enabling a user to adjust the heating characteristics of the heating wire.

An advantage of the atomizer for an electronic smoking device according to the present invention is that a resistance of a heating wire can be easily adjusted by a user. Furthermore a worn portion of the heating wire can be easily replaced by changing a portion at which the contact finger electrically connects the heating wire to a power source such as a rechargeable battery.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DETAILED DESCRIPTION OF THE DRAWINGS

Figure 1:
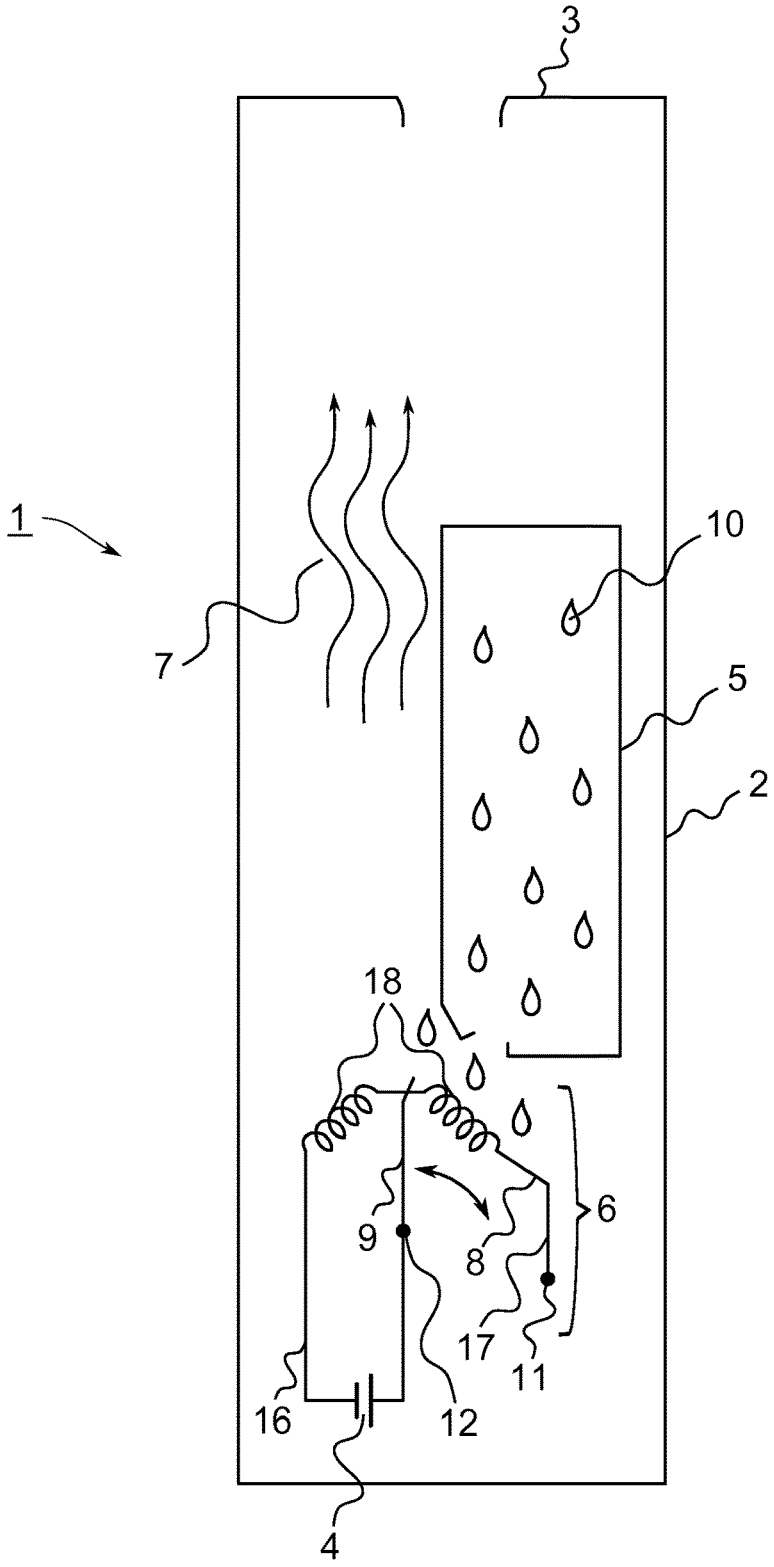
FIG. 1 is a schematic cross sectional view of an electronic smoking device according to a first embodiment of the present invention.

FIG. 1 shows a schematic cross sectional view of an electronic smoking device according to a first embodiment of the present invention. The electronic smoking device 1 is designed as an electronic cigarette and comprises a mouthpiece 3 which is attached to the housing 2.

In this embodiment the mouthpiece 3 has a tubular shape with a tapered portion and is attached to the housing 2 of the electronic smoking device 1 which has a substantially cylindrical shape. The housing 2 accommodates an atomizer 6 with a heating wire 8 and a reservoir 5 for storing a liquid 10 therein, wherein the atomizer 6 is adapted to vaporize the liquid 10 supplied from the reservoir 5.

The reservoir 5 comprises a capsule which is arranged adjacent to the atomizer 6 and which is filled with a liquid 10. However, the reservoir 5 also may be realized as any other kind of receptacle that can have an arbitrary form or shape and also be located in another position inside the housing 2. In this embodiment of the present invention, the liquid 10 exemplarily comprises a mixture of glycerol and a vanilla extract. However, the liquid 10 is not limited thereto and it is possible to realize electronic smoking devices 1 with other liquids e.g. propylene glycol, triethylene glycol, polyhydric alcohol, tetraethylene glycol, aliphatic ester of carboxylic acid, such as methyl stearate, dimethyl dodecanedioate, dimethyl tetradecanedioate, water and the like.

In addition, flavoured materials may be added to the liquid 10, for example esters, such as isoamyl acetate, linalyl acetate, isoamyl propionate, linalyl butyrate and the like or natural essential oils as plant essential oils, such as spearmint, peppermint, cassia, jasmine and the like or animal essential oils, such as musk, amber, civet, castor and the like or simple flavouring materials, such as anethole, limonene, linalool, eugenol and the like or hydrophilic flavour components such as a leaf tobacco extract or natural plant flavouring materials such as licorice, St. John's wort, a plum extract, a peach extract and the like or acids such as a malic acid, tartaric acid, citric acid and the like or sugars such as glucose, fructose, isomerized sugar and the like or polyhydric alcohols such as propylene glycol, glycerol, sorbitol and the like. It is also possible to combine different flavoured materials as mentioned above into new flavoured materials. Moreover, it is possible to adsorb any flavour onto a solid material and to use this material as flavoured material within an electronic smoking device 1 according to the present invention.

When triggered by a user of the electronic smoking device 1, liquid 10 is drawn from the reservoir 5 by capillary action and provided to the atomizer 6 where it is atomized or vaporized. However, the present invention is not limited to such vaporized liquids and it is possible to realize other embodiments of the electronic smoking device 1 which e.g. generate an aerosol from a solid material.

The electronic smoking device 1 comprises a flow path located inside the housing 2 extending from the heating element 6 to the mouthpiece 3. In this first embodiment of the present invention, an opening is arranged at an upper portion of the housing 2 which represents an outlet for vaporized liquid 7 towards the mouthpiece 3. The housing 2 may accommodate one or more guiding elements such as a separation wall or a deflection member which define or determine the course of the flow path inside the housing 2 of the electronic smoking device 1. Such guiding elements may be positioned between an outlet of the reservoir 5 and the opening of the housing 2 and are adapted to guide the vaporized liquid 7 to stream along a predefined flow path. In this sense, the opening of the housing 2 also functions as a guiding element which determines the course of the flow path inside the housing 2.

In this embodiment, the atomizer 6 comprises a heating wire 8 which is formed of two heating coils 18. The heating wire 8 extends from a first terminal end 16 which is electrically connected to a positive pole of a battery 4 functioning as a power source to a second terminal end 17 which is connected to a floating potential 11. In this embodiment, the floating potential 11 is formed as a terminal wire which is electrically insulated from surrounding components. However, the present invention is not limited to such a floating potential 11 and it is possible to realize other embodiments of the atomizer 6 with a floating potential 11 that differs from the embodiment shown in the FIG. 1. For example, the floating potential 11 may be formed as a resistor with a high electrical resistance that is connected to the housing 2. Alternatively, the floating potential 11 may be connected to an adjustable power source for supplying a predetermined electrical potential to the second terminal end 17 of the heating wire 8.

In this embodiment, an wire is provided having a straight section as part of the heating wire 8 thereby forming a first contact portion P1 between a first heating coil 18 which faces towards the first terminal end 16 and a second heating coil 18 which faces towards the second terminal end 17. Another straight section of the wire 8 is provided thereby forming a second contact portion P2 between the second heating coil 18 and the second terminal end 17. Each of the straight sections protrudes upwards from a plane in which the heating coils 18 are located (illustrated by the paper plane).

In this embodiment, the atomizer 6 further comprises a contact finger 9 which is formed as a longish rotatable pin such as a metal rod. The contact finger 9 is adapted to rotate around its rotation axis 12 which extends perpendicularly to said plane in which the heating coils 18 are located. The rotation axis 12 may extend in parallel with a longitudinal axis of the housing 2. A terminal portion of the contact finger 9 located at the rotation axis 12 is electrically connected to a negative pole of the battery 4. A rotation plane of the contact finger 9 is elevated above the heating coils 18 such that the contact finger 9 does not contact the heating coils 18 when rotating around axis 12. That is, the contact finger 9 overflies the heating coils 18 when rotating around the axis 12 without electrically or mechanically contacting the heating coils 18. An opposite terminal portion of the contact finger 9 facing away from the rotation axis 12 however mechanically contacts the protruding (i.e. elevated) straight sections of the wire 8 at the contact portions P1 and P2 when rotating into the respective direction. Due to the mechanical (and accordingly also electrical) contact between the contact finger 9 and the heating wire 8 at one of the contact portions P1 and P2, an electrical current flows through the heating wire 8 provided that a potential difference is applied to the heating wire 8 between the first terminal end 16 and the respective contact portion P1, P2. In this embodiment, the contact portions P1, P2 are formed as straight sections of the wire 8 and the contact finger 9 is formed as longish rotatable pin. However, the present invention is not limited to such contact portions P1, P2 and such a contact finger 9 and it is possible to realize other embodiments of the atomizer 6 with contact portions/contact finger that differ from the embodiment shown in the FIG. 1. For example, the contact portions P1, P2 may be formed to have any suitable shape such as a plate or the like. Furthermore, the contact finger 9 may be formed to have any suitable shape such as a hook or the like.

In the embodiment of FIG. 1, the contact finger 9 mechanically and electrically contacts the first contact portion P1 and accordingly a current only flows through the first heating coil 18 which is arranged between the first contact portion P1 and the first terminal end 16 of the heating wire 8. Accordingly, the amount of coiled heating wire is less compared to a position of the contact finger 9 in which it contacts the second contact portion P2. That is, the resistance of the heating wire 8 can be altered by rotation of the contact finger 9. In the present embodiment, a resistance of the heating wire 8 is greater in a position of the contact finger 9 contacting the second contact portion P2 compared to a position of the contact finger 9 contacting the first contact portion P1. In other words, the heating wire 8 will become hotter in a position of the contact finger 9 contacting the first contact portion P1 compared to a position of the contact finger 9 contacting the second contact portion P2. According to the present invention, a user can control the position of the contact finger 9 thereby adjusting the heating characteristics of the atomizer 6. Alternatively, a position of the contact finger 9 can be controlled by means of control electronics of an electronic smoking device.

A further advantage of the atomizer 6 for an electronic smoking device 1 according to the present invention is that it can be used with an electronic smoking device with a invariable power source while providing different heating characteristics. That is, conventional atomizers require to control a voltage applied to a heating wire for controlling (varying) the heating characteristics. However, the electronic smoking device according to the present invention does not need to control the amount of a voltage applied to a heating wire because it allows an adjustment of the heating characteristics by a relative movement of the contact finger and the heating wire which result in different contact positions.

In this embodiment, the atomizer 6 comprises two contact portions P1, P2 and two heating coils 18. However, the present invention is not limited to such an atomizer 6 and it is possible to realize other embodiments of the atomizer 6 with a different number of contact portions and heating coils.

Furthermore, the number of contact portions can differ from the number heating coils. In the same way, the arrangement of the contact portions and the heating coils can differ from the embodiment shown in FIG. 1.

In this embodiment, the contact finger 9 is adapted to rotate with respect to the heating coils 18 that are fixed to the housing 2, however, the present invention is not limited to such a rotatable contact finger 9 and it is possible to realize other embodiments where the contact finger 9 is fixed with respect to the housing 2 while the plurality of heating coils 18 are adapted to rotate with respect to the fixed contact finger 9. It would also be possible that both, the contact finger 9 and the heating coils 18 are adapted to rotate with respect to each other.

Figure 2:
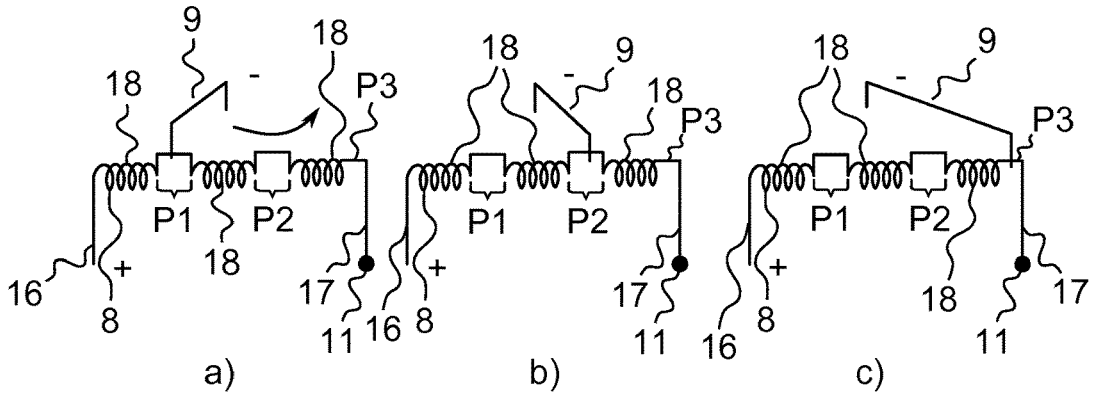
FIG. 2*a* is a schematic view of an atomizer of a second embodiment according to the present invention.
FIG. 2*b* is a schematic view of the atomizer shown in FIG. 2*a* where the contact finger is located in a different contact portion.
FIG. 2*c* is a schematic view of the atomizer shown in FIG. 2*a* where the contact finger is located in a different contact portion.

FIGS. 2*a* to 2*c* are schematic views of an atomizer of a second embodiment according to the present invention having three different contact positions P1, P2 and P3. In FIG. 2*a*, the contact finger 9 which is connected to a negative pole of a power source contacts the first contact portion P1 which is located between two adjacent heating coils 18. Furthermore a positive pole of the power source is connected to a first terminal end 16 of the heating wire 8 which comprises three heating coils 18 and four different contact portions P1, P2 and P3 while a second terminal end 17 is connected to a floating potential (e.g. grounded). Therefore a current flows through one heating coil 18 during operation of the atomizer.

In FIG. 2*b*, the contact finger 9 contacts the second contact portion P2 which is also located between two adjacent heating coils 18. Therefore a current flows through two heating coils 18 during operation of the atomizer.

In FIG. 2*c*, the contact finger 9 contacts the third contact portion P3 which is located between an outermost heating coil 18 facing away from the first terminal end 16 and the second terminal end 17. Therefore a current flows through three heating coils 18 during operation of the atomizer. It becomes clear that the position of the contact finger 9 alters the number of heating coils 18 through which a current flows during operation thereby adjusting the temperature of the heating element. In this second embodiment, the contact finger 9 may be laterally moved for contacting different contacting portions P1, P2 and P3.

Increasing the number of used coils 18 (or resistance) for a fixed voltage supply will reduce power thereby reducing the heat generated and reducing the amount of vapour. That is, the user can control the amount of vapour by controlling the position of the contact finger 9.

According to a preferred embodiment of the present invention, a wire diameter is uniform along the whole heating wire 8, however, the present invention is not limited to such an arrangement of the heating wire 8. It is possible to realize other embodiments where the wire diameter of the heating wire 8 changes from one heating coil 18 (coiled section) to the next heating coil 18, offering different resistance/surface area ratios which provide a further opportunity for controlling the amount of vapour by the user.

Figure 3:
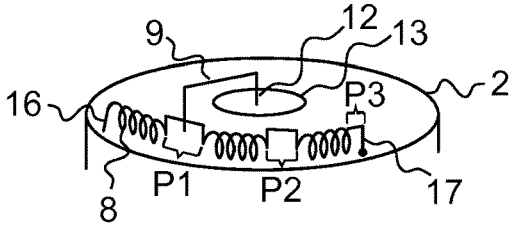
FIG. 3 is a schematic cross sectional view of an electronic smoking device according to a third embodiment of the present invention.

FIG. 3 is a schematic cross sectional view of an electronic smoking device according to a third embodiment of the present invention. Similarly to the second embodiment shown in FIGS. 2*a* to 2*c*, the heating wire 8 comprises three heating coils 18. However, the number and arrangement of heating coils 18 is not limited thereto. The third embodiment of the present invention is substantially identical to the second embodiment of the electronic smoking device 1 as shown in FIGS. 2*a* to 2*c* and as described hereinbefore. However, some of the components of the second embodiment of the present invention differ from the respective components with the same reference signs of the first embodiment of the present invention. Therefore, the differences of the second embodiment in comparison to the second embodiment will be described hereinafter.

In this third embodiment of the present invention, the heating coils 18 are not arranged along a straight line but the heating coils 18 are circularly arranged within the housing 2 of the electronic smoking device. That is, the contact finger 9 has a rotation axis 12 which extends along a central portion of a cross section of the housing 2. The heating coils 18 are circularly arranged close to an inner wall of the housing 2. In this case, however, the complete heating wire 8 is electrically insulated from the housing 2. A length extension of the contact finger 9 is smaller than half a diameter of the cross section of the housing 2. A length extension of the contact finger 9 may range between 20 and 45% of the diameter of the cross section of the housing 2. Similarly to FIGS. 2*a* to 2*c*, the contact finger 9 is connected to a negative pole of a power source and contacts the first contact portion P1 which is located between two adjacent heating coils 18. Furthermore a positive pole of the power source is connected to a first terminal end 16 while a second terminal end 17 is connected to a floating potential. The position of the contact finger 9 alters the number of heating coils 18 through which a current flows thereby adjusting the temperature of the heating wire 8.

Each of the plurality of different contact portions P1, P2 and P3 may have the same or substantially the same distance from the first rotation axis 12 due to their circular arrangement. That is, linear relative movement between the heating wire 8 and the contact finger 9 can be avoided. Further, a size of the contact portions P1, P2 and P3 can be reduced while simultaneously assuring firm contact between the contact finger 9 and the respective contact portion. The plurality of contact portions P1, P2 and P3 may furthermore be equidistantly spaced apart from one another which facilitates changing the position of the contact finger 9 from one contact portion to another contact portion due to the fact that a required rotation angle remains constant.

FIGS. 4*a* to 4*b* are schematic views of an atomizer of a fourth embodiment according to the present invention having four different contact portions P1, P2, P3 and P4. Similarly to the second embodiment shown in FIGS. 2*a* to 2*c*, the heating wire 8 comprises three heating coils 18 for the sake of illustration. However, the number and arrangement of heating coils 18 is not limited thereto. The fourth embodiment of the present invention is partly identical to the second embodiment of the electronic smoking device 1 as shown in FIGS. 2*a* to 2*c* and as described hereinbefore. However, some of the components of the second embodiment of the present invention differ from the respective components with the same reference signs of the first embodiment of the present invention. Therefore, the differences of the fourth embodiment in comparison to the second embodiment will be described hereinafter.

In FIG. 4*a*, a first contact finger 9 and a second contact finger 14 are provided. The first contact finger 9 is connected to a positive pole of a power source and contacts the first contact portion P1 which is located between the first terminal end 16 and a heating coil 18 located next to the first terminal end 16. The second contact finger 14 is connected to a negative pole of a power source and contacts the second contact portion P2 which is located between two adjacent heating coils 18 one of which being located next to the first terminal end 16. That is, the second contact finger 14 supplies a second electrical potential to the heating wire 8 that differs from the first electrical potential supplied by the first contact finger 9. Furthermore, each of the first terminal end 16 and the second terminal end 17 is connected to a resistor 13 which is fixed to the housing 2. In this embodiment, both resistors 13 are electrically insulated from one another. Furthermore, both contact fingers 9, 14 are electrically insulated from one another. For avoiding a short circuit, the second contact finger 14 contacts the heating wire 8 at a contact portion P2 being different to a contact portion P1 at which the first contact finger 9 contacts the heating wire 8. It becomes clear that the position of both contact fingers 9, 14 defines the number of heating coils 18 through which a current flows thereby adjusting the temperature of the heating wire 8.

A further advantage of the atomizer for an electronic smoking device according to this embodiment of the present invention is that different portion (i.e. different heating coils 18) of the heating wire 8 can be used and accordingly a lifetime of the atomizer can be increased. That is, a user can simultaneously rotate the contact fingers 9, 14 when a currently used portion of the heating wire 8 (i.e. one or more succeeding heating coils 18) is worn out. Even if the user does not want to alter the heating characteristics, i.e. maintain the number of the used coils 18, it is possible to substitute the currently used portion (one or more succeeding heating coils 18 implemented between the contact fingers 9, 14) when rotating the contact fingers 9, 14 and maintaining an angle between them. Alternatively, the electronic smoking device according may comprise control means for substituting a used portion of the heating wire 8 depending on the degree of deterioration of the respective portion (one or more succeeding heating coils 18). The degree of deterioration can be measured by an increase in wire resistance. Therefore an automatic detection of a worn out coil 18 may comprise means for detecting an electrical resistance of the heating wire 8 and means for substituting a currently used portion when the detected electrical resistance of the heating wire 8 is greater than a predetermined value.

In FIG. 4*b*, the first contact finger 9 contacts the third contact portion P3 which is located between two adjacent heating coils 18 one of which being located next to the second terminal end 17. The second contact finger 14 contacts the fourth contact portion P4 which is located next to the second terminal end 17. Similarly to FIG. 4*a*, current flows through one heating coil 18 during operation of the atomizer. Nevertheless, different coils 18 can be used by rotation of the contact fingers 9, 14 which allows altering the used portion until all configurations are used up. It is also possible to alter the heating temperature by changing the number of used heating coils 18. In such a case it is preferred to provide control means for balancing a degree of deterioration of all portions to be equal or substantially equal. In other words, if a deterioration degree of a certain portion (one or more succeeding heating coils 18 implemented between the contact fingers 9, 14) exceeds a predetermined value, this portion shall be discarded while heating operation is performed using the residual portions that underrun said predetermined value. In this way it is assured that the atomizer reaches a maximum lifetime under the given heating requirements. In a still more preferred embodiment, the used portions are altered in a predetermined recurring manner (even if not exceeding said predetermined value) thereby advantageously allowing regeneration and preventing overheating.

Figure 4:
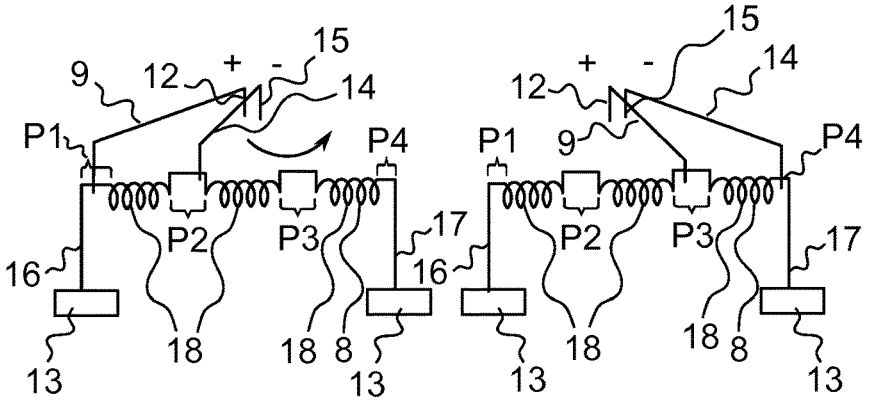
FIG. 4*a* is a schematic view of an atomizer of a fourth embodiment according to the present invention where two contact fingers are provided.
FIG. 4*b* is a schematic view of the atomizer shown in FIG. 4*a* where the contact fingers are located in a different contact portion.

For adjusting the position of the contact finger 9 or the contact fingers 9 and 14, respectively, the atomizer 6 may be split into two sections, one located above the other and connected by a central axis connecting pin. The two sections are locked together (e.g. using a spring, a magnet or a mechanical interlock) during operation of the atomizer 6. For changing the orientation of the contact finger(s) 9(, 14) with respect to the contact portions P1, P2, P3(,P4), the two sections are pulled apart by a user so that they can rotate around the axis of the connecting pin which may coincide with the rotation axis 12 or at least one of rotation axes 12, 15. The rotation causes the contact finger(s) 9(, 14) to land on a different contact portions P1, P2, P3(,P4) of the heating wire 8. This applies both, atomizers where there is only one contact finger 9 (FIGS. 1 to 3 and 7) or to atomizers with two contact fingers 9, 14 for moving said contact fingers 9, 14 from a used wire section to an unused wire section (FIGS. 4 to 6).

Figure 5:
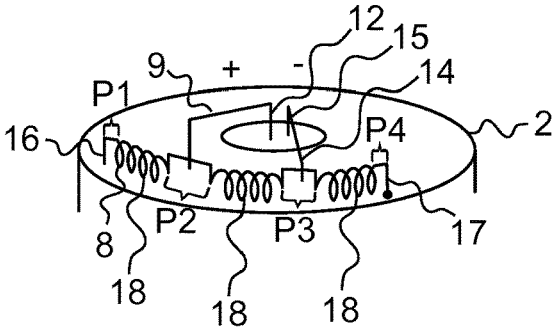
FIG. 5 is a schematic cross sectional view of an electronic smoking device according to a fifth embodiment of the present invention.
Figure 6:
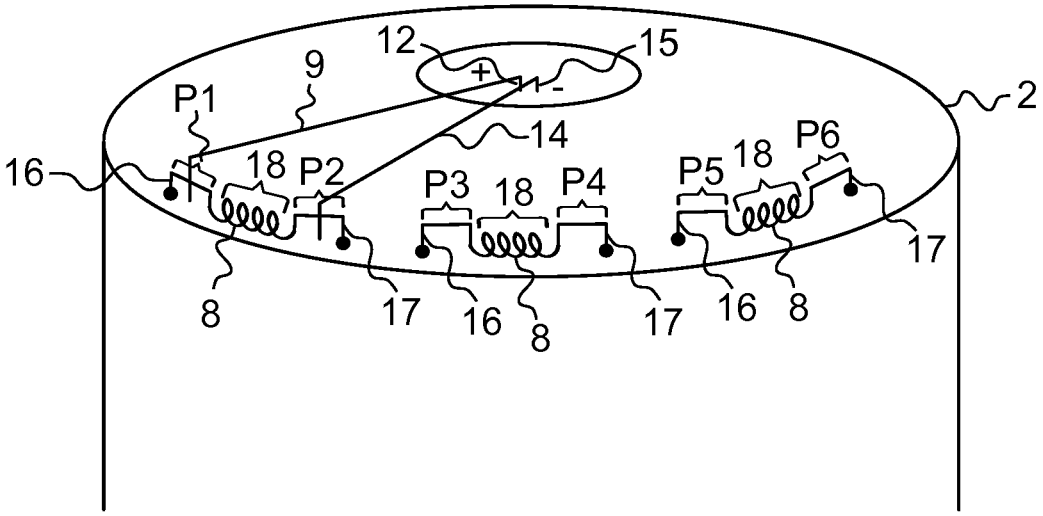
FIG. 6 is a schematic cross sectional view of an electronic smoking device according to a sixth embodiment of the present invention.

FIG. 5 is a schematic cross sectional view of an electronic smoking device according to a fifth embodiment of the present invention. Similarly to the third embodiment shown in FIG. 3, the heating wire 8 comprises three heating coils 18 for the sake of illustration. However, the number and arrangement of heating coils 18 is not limited thereto. The fifth embodiment of the present invention is partly identical to the third embodiment of the electronic smoking device 1 as shown in FIG. 3 and as described hereinbefore. However, some of the components of the fifth embodiment of the present invention differ from the respective components with the same reference signs of the third embodiment of the present invention. Therefore, the differences of the fifth embodiment in comparison to the third embodiment will be described hereinafter.

In this fifth embodiment of the present invention, the heating wire 8 does not comprise a single contact finger 9 but comprises a first contact finger 9 and a second contact finger 14. Both contact fingers 9, 14 are formed as rotatable pins, wherein each pin is formed as an elongated metal rod. Furthermore, the heating coils 18 are not arranged along a straight line but the heating coils 18 are circularly arranged within the housing 2 of the electronic smoking device. Both fingers 9, 14 have their respective rotation axes 12, 15 arranged to extend along a central portion of a cross section of the housing 2. Both rotation axes 12, 15 are located close to one another, however, the contact fingers 9, 14 are electrically insulated from one another. In more particular, a distance between the first rotation axis 12 and the second rotation axis 15 is smaller than a distance between adjacent heating coils 18. The housing 2 of the electronic smoking device comprises an elongated shape and a longitudinal axis of the housing 2 is parallel to both, the first rotation axis 12 of the first contact finger 9 and the second rotation axis 15 of the second contact finger 14. A length extension of each of the contact fingers 9, 14 is smaller than half a diameter of the cross section of the housing 2. A length extension of each of the contact fingers 9, 14 may range between 20 and 45% of the diameter of the cross section of the housing 2.

Similarly to FIGS. 4*a* and 4*b*, the first contact finger 9 is connected to a positive pole of a power source, the second contact finger 14 is connected to a negative pole of a power source and each of the first terminal end 16 and the second terminal end 17 is connected to a resistor. The first contact finger 9 contacts the second contact portion P2 which is located between two adjacent heating coils 18 one of which being located next to the first terminal end 16. Furthermore, the second contact finger 14 contacts the third contact portion P3 which is located between two adjacent heating coils 18 one of which being located next to the second terminal end 17. Similarly to FIGS. 4*a* and 4*b*, current flows through one heating coil 18 during operation of the atomizer.

Nevertheless, a different heating coil 18 is used compared to FIGS. 4*a* and 4*b* thereby enhancing the overall lifetime of the atomizer.

FIG. 6 is a schematic cross sectional view of an electronic smoking device according to a sixth embodiment of the present invention. Similarly to the fifth embodiment shown in FIG. 5, the heating wire 8 comprises three heating coils 18 for the sake of illustration. However, the number and arrangement of heating coils 18 is not limited thereto. The sixth embodiment of the present invention is partly identical to the fifth embodiment of the electronic smoking device 1 as shown in FIG. 5 and as described hereinbefore. However, in this sixth embodiment, the heating coils 18 are not electrically (physically) connected to each other. In this embodiment the angle between the contact fingers 9, 14 is fixed such that current flows through one heating coil 18. The angle between the contact fingers 9, 14 may be constant at all times of operation. In FIG. 6, the first contact finger 9 contacts the first contact portion P1 and the second contact finger 14 contacts the second contact portion P2. For expanding the overall lifetime of the atomizer however, the contact fingers 9, 14 may mutually be rotated when the currently used heating coil 18 malfunctions such that the first contact finger 9 contacts the third contact portion P3 and the second contact finger 14 contacts the fourth contact portion P4 or such that the first contact finger 9 contacts the fifth contact portion P5 and the second contact finger 14 contacts the sixth contact portion P6.

Figure 7:
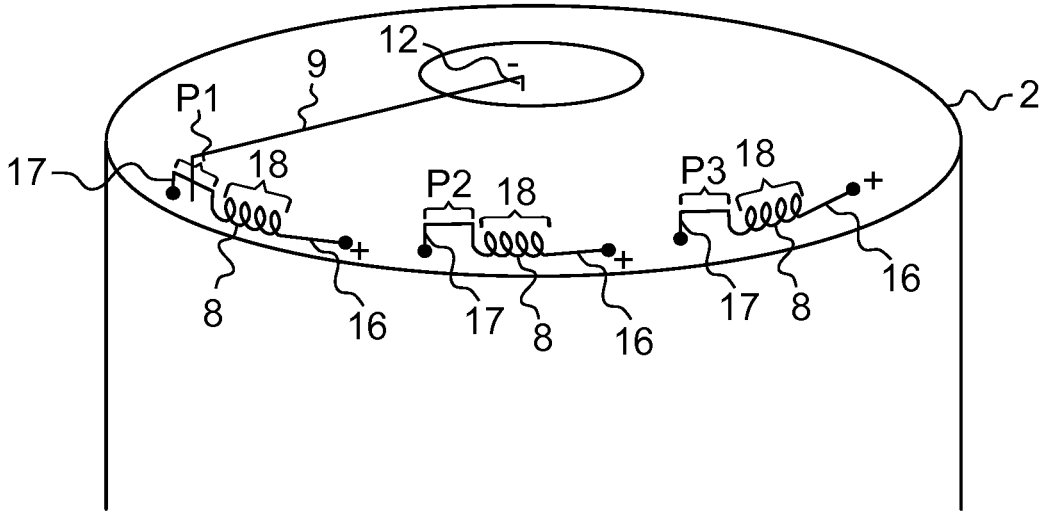
FIG. 7 is a schematic cross sectional view of an electronic smoking device according to a seventh embodiment of the present invention.

FIG. 7 is a schematic cross sectional view of an electronic smoking device according to a seventh embodiment of the present invention. Similarly to the sixth embodiment shown in FIG. 6, the heating coils 18 are separated from one another, i.e. they are not electrically (and also not physically) connected to each other. The seventh embodiment of the present invention is partly identical to the sixth embodiment of the electronic smoking device 1 as shown in FIG. 6 and as described hereinbefore. However, in this seventh embodiment, only one contact finger 9 is used instead of two different contact fingers used in the sixth embodiment. In this embodiment, a positive pole of the power source is connected to a first terminal end 16 of each heating wire 8, where each heating wire 8 comprises one contact portion, i.e. the left heating wire 8 comprises a first contact portion P1, the middle heating wire 8 comprises a second contact portion P2 and the right heating wire 8 comprises a third contact portion P3. Furthermore each heating wire 8 comprises a second terminal end 17 being connected to a floating potential (e.g. grounded). Therefore a current flows through one heating coil 18 during operation of the atomizer where the heating coil 18 to be used is selected by the position of the contact finger 9. For expanding the overall lifetime of the atomizer, the contact finger 9 may be rotated (either automatically or by a user) when the currently used heating coil 18 malfunctions (or is worn out) such that the first contact finger 9 contacts another contact portion, e.g. the second contact portion P2 or the third contact portion P3 thereby selecting a new heating coil 18.

In the previous embodiments, the heating coils 18 have been positioned in sequence to one another; however, the present invention is not limited to such an arrangement of the heating coils 18. It is possible to realize other embodiments where the heating coils 18 are vertically stacked one above another, wherein the contact fingers 9, 14 are formed as vertically sliding contact fingers 9, 14.

In the previous embodiments, the contact fingers 9, 14 are adapted to rotate (or laterally move or move otherwise) with respect to the heating coils 18 that are fixed to the housing 2, however, the present invention is not limited to such a rotatable contact fingers 9, 14 and it is possible to realize other embodiments where the contact fingers 9, 14 are fixed with respect to the housing 2 while the plurality of heating coils 18 are adapted to rotate with respect to the fixed contact finger 9 (or laterally move or move otherwise). It would also be possible that both, the contact fingers 9, 14 and the heating coils 18 are adapted to rotate (or laterally move or move otherwise) with respect to each other.

Although in the above embodiments electronic smoking devices have been described in which liquid is atomised by being heated by a heating wire, it will be appreciated that in other embodiments other means for generating a vapour such as piezoelectric elements could be used instead of a heating wire. Such of piezoelectric elements may be adapted to generate an aerosol by vibrating the liquid to produce small droplets.

It will also be appreciated that although in some embodiments a puff detector for detecting a user puffing on a device could be provided and the puff detector could be arranged to initiate the activation of an atomizer when a user puffed on the device, in some embodiments the puff detector could be replaced by a push button and a user could be cause an atomizer to activate by pressing on the button. In other embodiments other means for activating the device could be provided.

While this invention has been described in connection with what is presently considered to be practical exemplary embodiments, it is to be understood that the present invention is not limited to the disclosed embodiments, but, on the contrary, is intended to cover various modifications and equivalent arrangements included within the scope of the appended claims.

LIST OF REFERENCE SIGNS

1 electronic smoking device
2 housing
3 mouthpiece
4 battery/power source
5 reservoir
6 atomizer
7 aerosol
8 heating wire
9 first contact finger
10 material to be vaporized
11 floating potential
12 rotation axis of first contact finger
13 resistor
14 second contact finger
15 rotation axis of second contact finger
16 first terminal portion of heating wire
17 second terminal portion of heating wire
18 heating coil
P1 first portion of heating wire
P2 second portion of heating wire
P3 third portion of heating wire
P3 fourth portion of heating wire
P5 fifth portion of heating wire
P6 sixth portion of heating wire

The invention claimed is:

1. An atomizer for an electronic smoking device being operable in use to generate an aerosol, comprising:

a heating wire, and at least a first contact finger adapted to supply a first electrical potential to the heating wire, wherein the first contact finger is adapted to contact the heating wire at a plurality of different contact portions, and wherein the heating wire comprises a plurality of separate heating coils sequentially arranged along the heating wire, wherein each of the contact portions is formed between adjacent heating coils.

2. The atomizer of claim 1, wherein the first contact finger is formed as a rotatable pin adapted to rotate around a first rotation axis.

3. The atomizer of claim 2, wherein the plurality of different contact portions are equidistantly spaced apart from the first rotation axis.

4. The atomizer of claim 1 wherein each of the contact portions protrudes from a connecting line between adjacent heating coils.

5. The atomizer of claim 1, wherein each of the contact portions is formed as a straight section of the heating wire.

6. The atomizer of claim 2, wherein the plurality of contact portions are circularly arranged around the first rotation axis and equidistantly spaced apart from each other.

7. The atomizer of claim 1, further comprising a second contact finger adapted to supply a second electrical potential to the heating wire that differs from the first electrical potential.

8. The atomizer of claim 7, wherein the second contact finger is adapted to contact the heating wire at a second plurality of different contact portions, wherein a contact portion of the first contact finger differs from a contact portion of the second contact finger.

9. The atomizer of claim 7, wherein the second contact finger is formed as a rotatable pin adapted to rotate around a second rotation axis.

10. The atomizer of claim 9, wherein the plurality of different contact portions are equidistantly spaced apart from the second rotation axis.

11. The atomizer of claim 7 wherein the first contact finger is formed as a first rotatable pin adapted to rotate around a first rotation axis, the second contact finger is formed as a second rotatable pin adapted to rotate around a second rotation axis, and a distance between the first rotation axis and the second rotation axis is smaller than a distance between adjacent heating coils.

12. The atomizer of claim 1 having a flow path extending from the heating wire to a mouthpiece, with the heating wire in the flow path.

13. The atomizer of claim 1 further comprising a reservoir positioned to provide a liquid onto the heating wire.

14. An electronic smoking device comprising:

a mouthpiece, an atomizer including a heating wire and at least a first contact finger adapted to supply a first electrical potential to the heating wire, wherein the first contact finger is adapted to separately contact the heating wire at each of a plurality of different contact portions, the heating wire comprises a plurality of separate heating coils sequentially arranged along the heating wire, and each of the contact portions is formed between adjacent heating coils, a reservoir, wherein the atomizer is adapted to vaporize a liquid supplied from the reservoir to generate an aerosol, and a housing accommodating the atomizer and the reservoir.

15. The electronic smoking device of claim 14, wherein the housing is elongated and a longitudinal axis of the housing is parallel to a first rotation axis of the first contact finger.

* * * * *